US006745419B1

(12) United States Patent
Delfs et al.

(10) Patent No.: US 6,745,419 B1
(45) Date of Patent: Jun. 8, 2004

(54) QUILTED-TOP FEATHERBED

(75) Inventors: Juliette M. Delfs, Seattle, WA (US); Wing Yee W. Chan, Seattle, WA (US)

(73) Assignee: Pacific Coast Feather Company, Seattle, WA (US)

( * ) Notice: Subject to any disclaimer, the term of this patent is extended or adjusted under 35 U.S.C. 154(b) by 0 days.

(21) Appl. No.: 09/474,339

(22) Filed: Dec. 29, 1999

(51) Int. Cl.[7] ..... A47C 27/00
(52) U.S. Cl. ..... 5/691; 5/499
(58) Field of Search ..... 5/691, 500, 499, 5/690, 652, 738, 501, 502

(56) References Cited

U.S. PATENT DOCUMENTS 4,549,323 A * 10/1985 Brockhaus ..... 5/502
4,922,564 A * 5/1990 Thomas ..... 5/727
4,930,170 A * 6/1990 Kobayashi ..... 5/12
4,955,095 A * 9/1990 Gerrick ..... 5/502
5,117,519 A * 6/1992 Thomas ..... 5/500
5,428,852 A * 7/1995 Tenuta et al. ..... 5/690
5,475,881 A * 12/1995 Higgins et al. ..... 5/737
5,557,816 A * 9/1996 Pedersen et al. ..... 5/645
6,009,579 A * 1/2000 Pedersen ..... 5/690

* cited by examiner

*Primary Examiner*—Heather Shackelford
*Assistant Examiner*—Fredrick Conley
(74) *Attorney, Agent, or Firm*—Jensen & Puntigam, P.S.

(57) ABSTRACT

The quilted-top featherbed includes a conventional featherbed, which is adapted and arranged to lie on top of a conventional bed mattress and is filled with feathers. A quilted-top member is secured around the periphery thereof to the featherbed, wherein the top member comprises successive layers of woven fabric, polyester batting and non-woven fabric, the three layers being secured together by a quilted stitching pattern.

6 Claims, 2 Drawing Sheets

QUILTED-TOP FEATHERBED

TECHNICAL FIELD

This invention relates generally to featherbeds and more particularly concerns a featherbed having a quilted-top member attached thereto.

BACKGROUND OF THE INVENTION

Featherbeds have long been known for their comfort as a bedding article, particularly when used on a conventional bed mattress. A featherbed is typically slim (approximately 2–10 inches high) with a filling of feathers or a combination of down and feathers. One disadvantage with conventional featherbeds is that, in use, the sharp feather quills will sometimes poke through the cover (tick) of the featherbed. Besides producing discomfort for the user, this can deplete the feather fill and sometimes even damage the tick by creating an opening in the tick, permitting feathers to more readily come through the tick. Accordingly, it would be advantageous to have a featherbed which includes protection against feathers poking through the tick.

SUMMARY OF THE INVENTION

Accordingly, the present invention is a quilted-top featherbed, which includes a featherbed member, adapted and arranged to lie on top of a conventional bed mattress in use; and a quilted-top member for the featherbed secured around the periphery thereof to the featherbed member, the quilted-top member being constructed and arranged so as to substantially prevent feathers in the filling of the featherbed from making a sensed contact with the user lying on the featherbed.

BEST MODE FOR CARRYING OUT THE INVENTION

Figure 1:
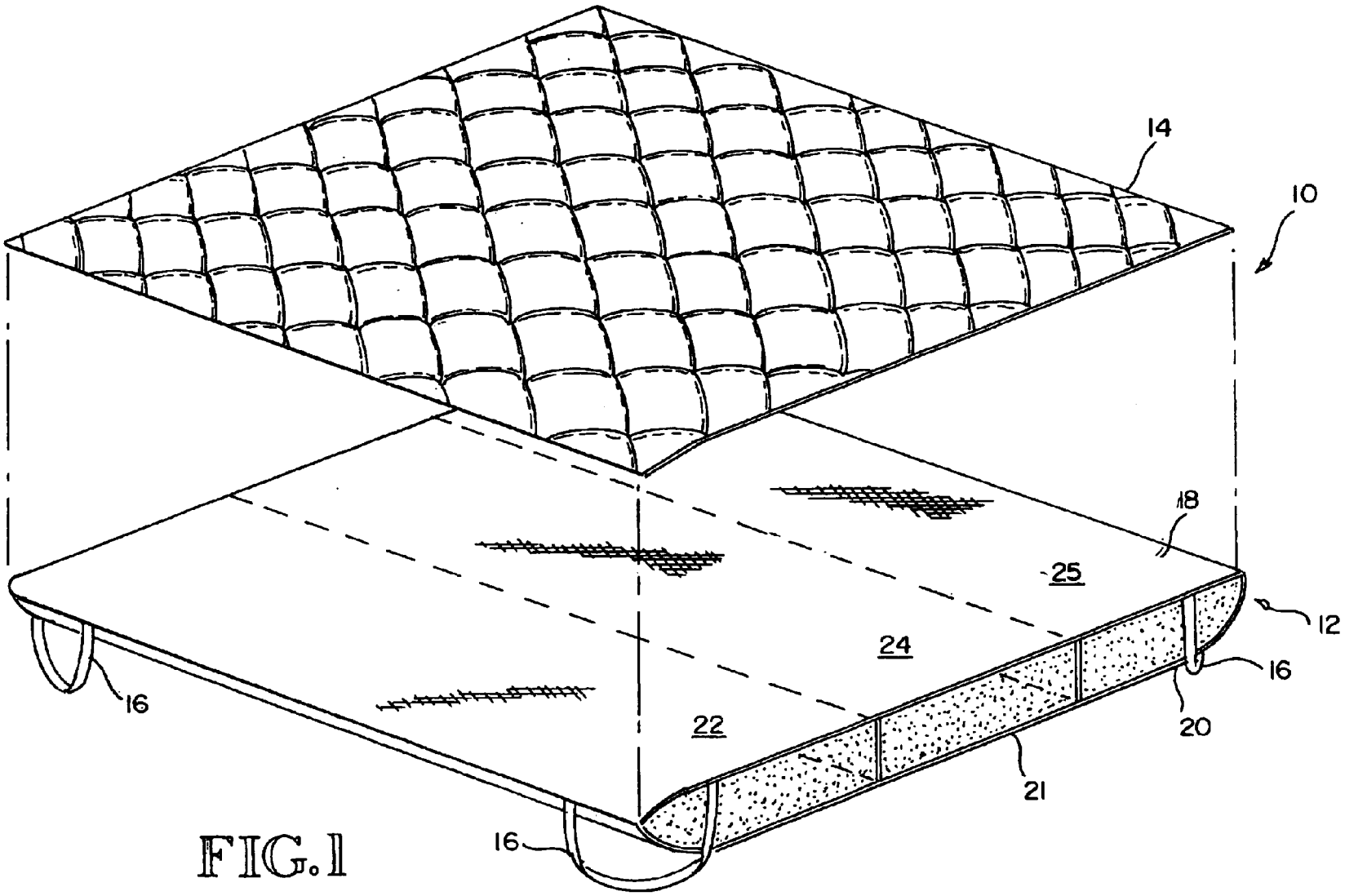
FIG. 1 is a perspective view showing the quilted top featherbed of the present invention, with the quilted-top member being exploded away from the featherbed member.

The quilted-top featherbed of the present invention is shown in FIG. 1, generally at 10. The quilted-top featherbed 10 comprises a conventional featherbed member 12 with a quilted top member 14 which is attached by stitching or other attaching means such as Velcro® or a zipper around the periphery thereof to the upper surface layer of featherbed 12. The quilted-top featherbed 10 in use lies on a conventional bed mattress (not shown) either with or without attachments to the bed mattress. The attachments could be corner bands 16 which extend from the featherbed around the corners of the mattress, or the attachments could actually connect in some fashion, such as by Velcro®, to the mattress.

Featherbed 12 is conventional in configuration and construction. Featherbed 12 can come in a variety of sizes, including, for instance twin, full, queen, king and California king sizes. The featherbed includes lower and upper layers 18 and 20. Layers 18 and 20 are both, in the embodiment shown, made of a woven fabric, stitched together around their respective peripheries so as to define a housing for the featherbed fill 21. In one example, the woven fabric layers are 230 count cambric 100% cotton. However, it should be understood that different fabric weights could be used. In the embodiment shown, featherbed 12 is divided into three longitudinal channels 22, 24 and 25 of approximately equal width. The featherbed 12 is constructed with channels to prevent undue migration of the filling during use and permit ease of fluffing, although featherbed channels are not necessary to the present invention.

The channels 22, 24 and 25 are filled with feathers, with the weight varying in accordance with different styles. Typically, the weight of a queen-size featherbed will be within the range of 6–14 lbs, with ranges 4–7 lbs for a twin size, 5–12 lbs for full size and 9–17 for king size. Some featherbeds will have a sufficient fill so that the featherbed will lie by itself on top of the bed mattress, while other lighter styles may have a band that will hold the featherbed to the bed mattress.

Figure 2:
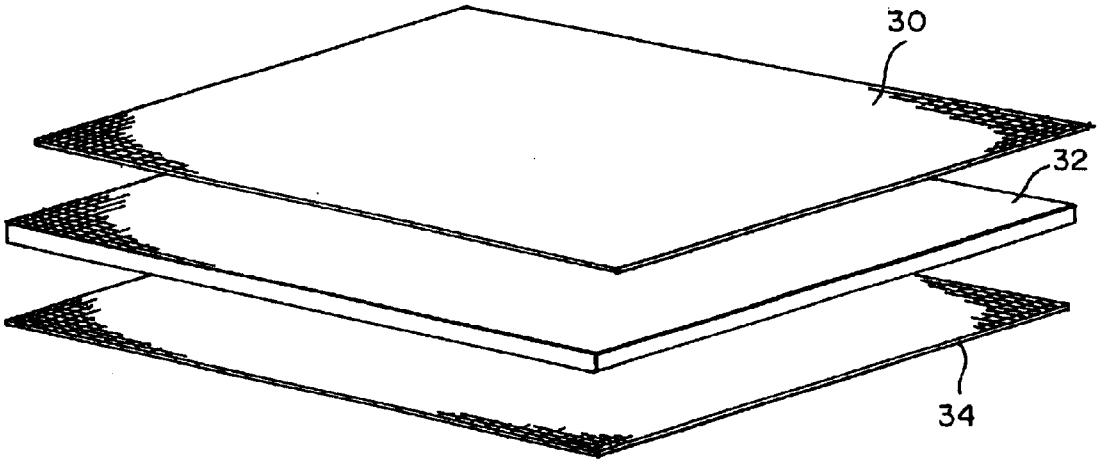
FIG. 2 is a perspective view of the quilted-top member of the combination of FIG. 1.
Figure 3:
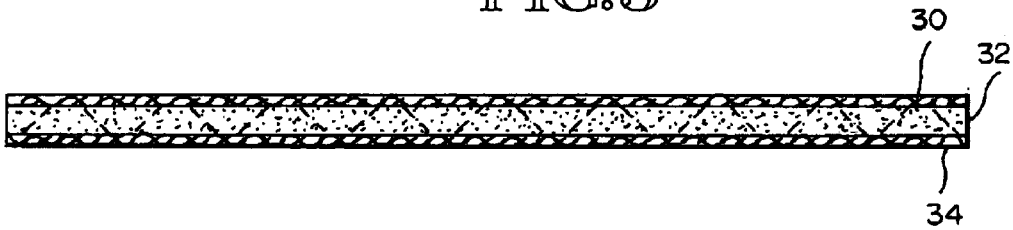
FIG. 3 is an elevational view of the quilted-top member shown in FIG. 2.

The quilted-top member 14 is shown in more detail in FIGS. 2 and 3. As indicated above, the quilted-top member 14 is attached around the periphery to the top of the featherbed 12. Alternatively, the quilted-top member 14 could itself be the top layer of the featherbed. In the embodiment shown, the quilted-top member 14 comprises three successive layers, including a top layer 30 of woven fabric, similar to layers 18 and 20 of featherbed 12, including cotton and/or cotton blends of various weights, e.g. 200, 230 or 260 thread count. Below the top woven fabric layer 30 is a layer of polyester batting 32. In the embodiment shown, the polyester batting is approximately ¼–2 inches thick and weighs typically approximately 80 grams. The polyester batting could have a weight within the range of 50–150 grams. The purpose of the polyester batting is to prevent the feather quills from reaching the user.

The next layer, below layer 32, is a nonwoven polyester scrim layer 34. Scrim layer 34 provides a base member for the quilting. Other elements which could be used include a woven fabric, of almost any weight.

The three layers 30, 32 and 34 are connected together by a quilt stitch pattern. In the embodiment shown, the quilt stitch pattern is a diagonal (diamond) pattern as shown in FIGS. 1 and 3. Other stitch patterns could be used, including channel or box, among others. The quilting stitch extends through the three layers 30, 32 and 34. The quilted-top member, being approximately ¼–3 inches thick in total, does not detract from the slim line of the featherbed.

The combination of fabric layer 30, polyester batting layer 32 and the polyester scrim layer 34 quilted together forms a barrier to prevent feather quills from poking through the featherbed tick and contacting the user. Furthermore, the quilted-top member adds to the existing cushioning effect of the featherbed, making the bed even more comfortable. Hence, the present invention, in a relatively simple but effective way, solves a significant problem of presently existing featherbeds and, in addition, adds to the overall comfort of the featherbed, without detracting from its basic function or appearance.

Hence, a preferred embodiment has been disclosed for purposes of illustration. However, it should be remembered that various changes, modifications and substitutions may be made to the embodiment without departing from the spirit of the invention, which is defined by the claims which follow.

What is claimed is:

1. A quilted-top featherbed, comprising:

a featherbed member, adapted and arranged to lie on top of a conventional bed mattress in combination therewith for support of a human body, the featherbed member being further adapted and arranged to be readily removable from the bed mattress, the featherbed member having a weight and fill suitable for use as a featherbed in combination with the bed mattress but not suitable as a mattress by itself; and a quilted-top member non-removably secured substantially continuously around the periphery thereof to the featherbed member, by a line of stitching, such that the quilted-top member is not removable from the featherbed member, the quilted-top member including an upper fabric layer, an intermediate layer and a lower fabric layer, wherein said upper, intermediate and lower layers are stitched together in a quilted pattern, wherein the intermediate layer extends substantially the entire length and width of the quilted-top member and comprises a material which prevents feather quills from the featherbed member from being sensed by a user lying on the quilted-top featherbed.

2. An article of claim 1, wherein the featherbed member includes a top layer in addition to the quilted-top member.

3. An article of claim 1, wherein the quilted-top member is permanently secured to the featherbed member and wherein the quilted-top member comprises a top layer of the featherbed member.

4. An article of claim 1, wherein the upper fabric layer is a cotton fabric, wherein the intermediate layer is polyester batting having a thickness of approximately ¼Z inches, and wherein the lower fabric layer is a non-woven fabric material.

5. An article of claim 1, including means for removably attaching a featherbed to a bed mattress.

6. An article of claim 1, wherein the featherbed has a fill weight within the range of 4–17 pounds, according to size, the featherbed being divided into a plurality of separate sections.

* * * * *